US006627065B1

(12) United States Patent
MacDowell et al.

(10) Patent No.: US 6,627,065 B1
(45) Date of Patent: Sep. 30, 2003

(54) LIQUID GALVANIC COATINGS FOR PROTECTION OF IMBEDDED METALS

(75) Inventors: Louis G. MacDowell, Satellite Beach, FL (US); Joseph J. Curran, Melbourne Beach, FL (US)

(73) Assignee: The United States of America as represented by the Administrator of the National Aeronautics & Space Administration, Washington, DC (US)

( * ) Notice: Subject to any disclaimer, the term of this patent is extended or adjusted under 35 U.S.C. 154(b) by 47 days.

(21) Appl. No.: 09/977,531

(22) Filed: Oct. 15, 2001

Related U.S. Application Data

(60) Provisional application No. 60/253,069, filed on Nov. 20, 2000.

(51) Int. Cl.[7] ..... C23F 13/00

(52) U.S. Cl. ..... 205/734; 205/740; 106/640; 106/772; 106/775; 106/801; 106/284.03; 106/284.3; 106/286.2; 106/286.6; 106/286.8

(58) Field of Search ..... 205/734, 740; 106/640, 772, 775, 801, 284.03, 284.3, 286.2, 286.6, 286.8

(56) References Cited

U.S. PATENT DOCUMENTS

| | | | | |
|---|---|---|---|---|
| 4,506,485 A | * | 3/1985 | Apostolos | 204/734 |
| 4,812,212 A | | 3/1989 | Dimond et al. | |
| 5,292,411 A | | 3/1994 | Bartholomew et al. | |
| 5,341,562 A | * | 8/1994 | Furuya et al. | 29/825 |
| 5,364,511 A | | 11/1994 | Moreland et al. | |
| 5,431,795 A | | 7/1995 | Moreland et al. | |
| 5,650,060 A | | 7/1997 | Huang et al. | |
| 5,789,106 A | | 8/1998 | Rosenmeier et al. | |
| 6,033,553 A | | 3/2000 | Bennett | |
| 6,440,332 B1 | * | 8/2002 | Geer et al. | 29/825 |
| 6,471,851 B1 | * | 10/2002 | Bennett | 205/734 |

OTHER PUBLICATIONS

MacDowell, Louis G., "Development of Liquid Applied Coatings for Protection of Steel in Concrete," (Oct. 13, 2000).

Gray, Kara L. et al., "Space–Age Coating Protects Structural Concrete: A NASA Technology to Protect your Investment and your Bottom Line," *SAMPE Journal*, vol. 37, No. 5, Sep./Oct. 2001.

* cited by examiner

*Primary Examiner*—Bruce F. Bell
(74) *Attorney, Agent, or Firm*—Randall M. Heald; Gary G. Borda; John G. Mannix

(57) ABSTRACT

Coating compositions and methods of their use are described herein for the reduction of corrosion in imbedded metal structures. The coatings are applied as liquids to an external surface of a substrate in which the metal structures are imbedded. The coatings are subsequently allowed to dry. The liquid applied coatings provide galvanic protection to the imbedded metal structures. Continued protection can be maintained with periodic reapplication of the coating compositions, as necessary, to maintain electrical continuity. Because the coatings may be applied using methods similar to standard paints, and because the coatings are applied to external surfaces of the substrates in which the metal structures are imbedded, the corresponding corrosion protection may be easily maintained. The coating compositions are particularly useful in the protection of metal-reinforced concrete.

37 Claims, 3 Drawing Sheets

LIQUID GALVANIC COATINGS FOR PROTECTION OF IMBEDDED METALS

STATEMENT OF RELATED APPLICATIONS

This application claims priority to United States Provisional Patent Application Ser. No. 60/253,069 filed Nov. 20, 2000 and titled "Liquid Applied Coatings for Protection of Metal," which is commonly assigned and incorporated by reference herein.

STATEMENT OF GOVERNMENT INTEREST

The invention described herein was made in the performance of work under a NASA contract and by an employee of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the contractor elected not to retain title.

TECHNICAL FIELD OF THE INVENTION

The present invention relates generally to corrosion reduction or mitigation, and in particular to the use of liquid applied coatings for substrate surfaces providing galvanic protection of metal structures imbedded within the substrate.

BACKGROUND OF THE INVENTION

Corrosion of reinforcing steel in concrete is an insidious problem, affecting structures, highway bridge infrastructure, and building structures. Since the corrosion of steel in concrete progresses inside of the formed concrete slabs, the imbedded steel surface to be protected is not readily available for coating operations. Providing protection to the steel to significantly slow or stop the corrosion process would prevent further structural deterioration of the reinforced concrete system.

Other techniques have been used recently to offer protection of the steel reinforcing bars inside concrete structures. These include migrating corrosion inhibitors and cathodic protection systems. The chemical inhibitors promise quick and inexpensive protection, however, the corrosion processes can still continue in areas not sufficiently treated. These materials only slow the corrosion process and can still lead to structural damage of the concrete. The cathodic protection methods promise to stop the corrosion process by providing electrical current or sacrificial anodes.

The simplest impressed current methods require coating of the structure with a conductive paint and applying current by the use of an externally connected power supply. This system is costly to install, requires continuous power with associated costs, and must be periodically monitored and maintained for the life of the structure. Other impressed current systems on the market can be even more complicated.

The sacrificial cathodic protection method currently in use in industry requires the application of metallic zinc by arc or thermal spray equipment. This equipment is bulky, expensive, requires high skill to operate. This process also requires high voltage electricity to operate. This high voltage requirement is a great safety concern.

The existing cathodic protection systems on the market can be costly to install and require continuing maintenance to allow for proper protection. The impressed current systems can be very complex to install and must be adjusted during operation to optimize protection. Some galvanic systems require the use of costly arc spray equipment to apply the metallic zinc used for the protective current.

For the reasons stated above, and for other reasons stated below that will become apparent to those skilled in the art upon reading and understanding the present specification, there is a need in the art for alternative methods and materials for reducing corrosion of imbedded metal structures.

SUMMARY

Coating compositions and methods of their use are described herein for the reduction of corrosion in imbedded metal structures. The coatings are applied as liquids to an external surface of a substrate in which the metal structures are imbedded. The coatings are subsequently allowed to dry. The liquid applied coatings provide galvanic protection to the imbedded metal structures. Continued protection can be maintained with periodic reapplication of the coating compositions, as necessary, to maintain electrical continuity. Because the coatings may be applied using methods similar to standard paints, and because the coatings are applied to external surfaces of the substrates in which the metal structures are imbedded, the corresponding corrosion protection may be easily maintained.

For one embodiment, the invention provides a method of preventing corrosion of metal in concrete. The method includes surrounding a metallic member with concrete and applying a liquid coating to the concrete surface, the liquid coating having metallic particles which provide a protective current to the metallic member.

For another embodiment, the invention provides a method of slowing corrosion of metal structures imbedded in a substrate. The method includes applying a liquid coating to an external surface of the substrate. The liquid coating includes zinc and magnesium in a coating vehicle in an amount sufficient to remain conductive after application.

For yet another embodiment, the invention provides a liquid coating. The liquid coating includes a volume of zinc, a volume of magnesium and a volume of a coating vehicle. The liquid coating includes a sufficient volume of the zinc and magnesium to remain conductive after any solvents in the coating vehicle are driven off.

Further embodiments of the invention include apparatus and methods of varying scope.

DETAILED DESCRIPTION

Figure 1:
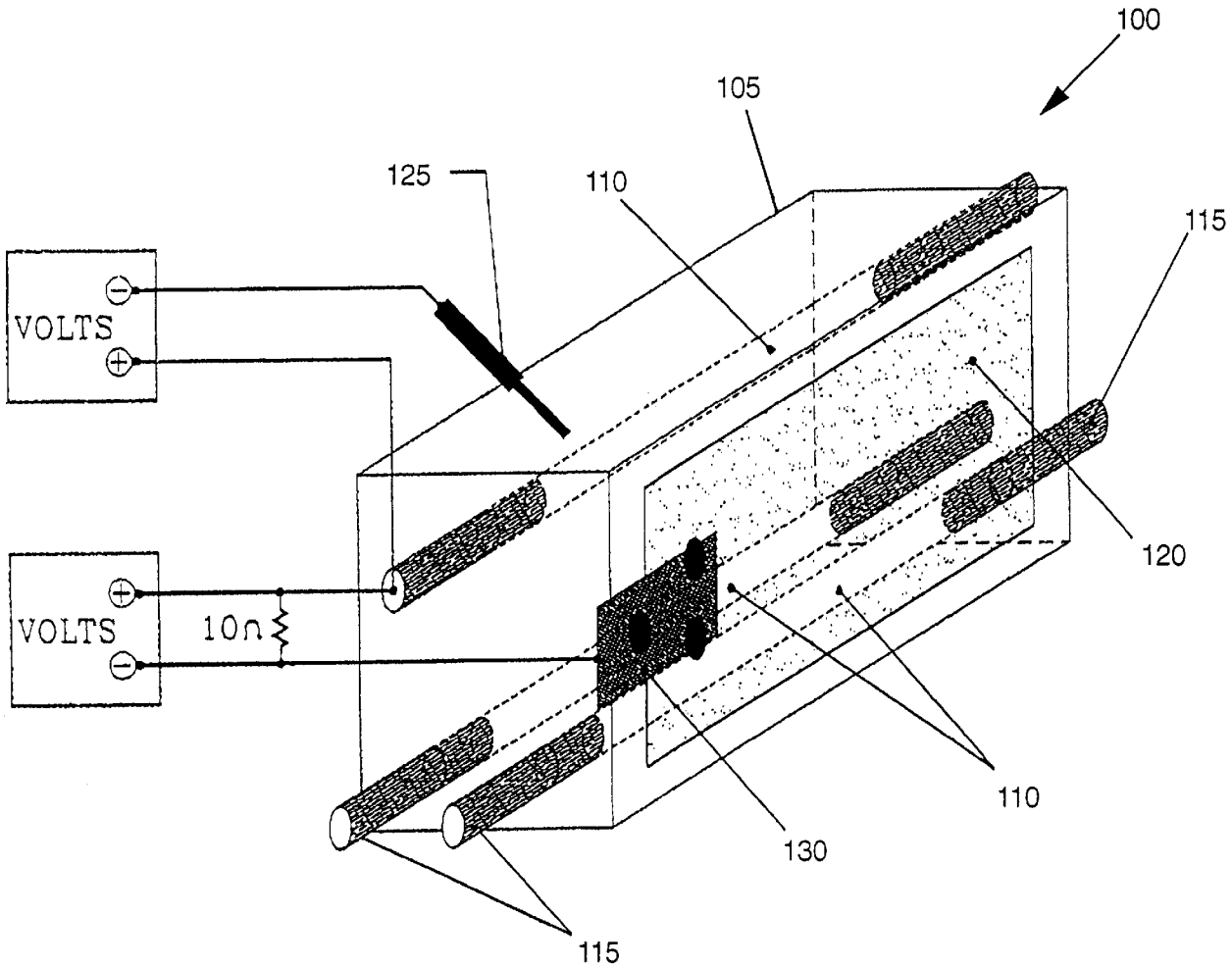
FIG. 1 is a perspective view of a test block showing an applied coating in accordance with an embodiment of the invention.

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

The present invention is directed to coatings and processes for coating for use in the protection of metal encased in a substrate. Such coatings and processes are particularly suited for the use of protecting metal reinforcement structures in concrete. The various embodiments include coatings including a liquid filled with metallic particles to provide a protective current to the encased metal. The coating is applied to an exterior surface of the substrate, e.g., concrete, using standard painting equipment. As examples, the coatings may be applied as one would typically apply paint, e.g., brushing, rolling or spraying.

Various embodiments include liquid applied processes with an inorganic coating filled with blended metallic particles and/or moisture attracting compounds to provide the protective current to encased metal, such as reinforcing steel, or rebar, in concrete. Testing has shown that a protective current can be found to flow to the interior steel reinforcement of concrete test blocks. Specific formulations of the coating have met NACE (National Association of Corrosion Engineers) depolarization criteria for complete protection of the steel rebar imbedded in concrete. By transferring the corrosion process from the steel reinforcement to the exterior coating, the corrosion of steel reinforcement can be significantly slowed or stopped. The exterior coating can be easily maintained or replaced as required to allow indefinite protection of the reinforcing steel.

Corrosion inhibiting liquids and methods of their use can significantly reduce labor costs for corrosion protection of imbedded steel in concrete, as compared to conventional methods and materials. Another advantage of this system will be that the equipment used to apply the coatings is readily available and at low cost, such as standard paint application tools or systems.

Typical costs of impressed current systems for concrete structures are relatively high. Aside from initial application costs, these systems further require electricity, periodic monitoring of system health, and power supply maintenance. The costs associated with these items are dependent on structure size and configuration. These systems are typically complex and require significant upkeep to assure reliability.

The sacrificial systems currently on the market generally require arc or thermal spray zinc. An advantage of these systems is that once they are installed, very little maintenance and upkeep is required. Another sacrificial system uses zinc sheet and conductive glue technology. Once again, the advantage of this system is very little maintenance after installation. Both of these commercial sacrificial systems use pure zinc as the sacrificial metal anode and purportedly promise a 10-year life expectancy. NACE International has stated that systems relying on pure zinc on concrete structures only provide partial protection due to their low driving voltages. Also upon exposure, the zinc anode passivates (becomes inactive), and during periods of dry weather does not supply adequate protective current to the steel rebar.

It is expected that the initial application costs of the various embodiments would be less than the impressed current systems or sacrificial systems as described above. The various embodiments require relatively little maintenance after installation and do not need any electricity to operate. The liquid coatings can be applied at thickness that would be expected to provide a 10 year life expectancy or greater. The coating could then be very easily refreshed at a much lower installation cost to provide indefinite protection to the imbedded metal structures.

Various materials were tested with regard to application characteristics, predictable galvanic activity, long-term protection, and minimum environmental impact. These new coating traits, along with the electrical connection system will successfully protect the imbedded reinforcing steel through the sacrificial cathodic protection action of the coating. Results of this Phase One testing are summarized below in Table 1.

The carrier matrix for the metal mixtures was a standard commercial product for industrial coatings, such as an inorganic silicate vehicle. Any thinner used with the carrier matrix was in accordance with the manufacturer's recommendations. The coating procedure was to apply two thin coats, about 1½ hours apart, to test blocks, to allow drying before the second coat. If the coating mixture was more viscous, only one coat was applied. Alternatively, if the coating was found to be too thin after two coats, a third was applied.

For the test results shown in Table 1, test blocks were exposed to the outdoor environment for approximately six days, during which there were two rain events, one minor and one major. The data for the major event are shown in Table 1, both before and after the rain. When the current and potential data are graphed and correlated with weather data, it can be seen that coatings with magnesium included have a longer protection period. This protection period starts sooner and ends later than the coatings without magnesium added.

TABLE 1

Results Summary of Phase One Measured in Concrete Test Blocks

| TEST PARAMETERS Phase One Designation | | | | BEFORE RAIN (Imbedded Electrode | | CHANGES AFTER RAIN EVENT | | | |
|---|---|---|---|---|---|---|---|---|---|
| Block # | Mg, % | Zn, % | Active[2] | I, μa | V, mV[1] Ag/AgCl | I, μA[3] | V, mV[3] Ag/AgCl | Corroding | Protected[1] |
| 3 | 0 | 0 | Yes | NA | −300 | NA | −330[4] | Yes | NA |
| 7 | 0 | 100 | No | 0 | −50 | +5 | −130[4] | ? | Low |
| 4 | 0 | 100 | Yes | +400 | −300 | +700 | −350[4] | ? | Med.–High |
| 1 | 25 | 75 | No | 0 | −30 | +270[4] | −260[4] | ? | ? |
| 8 | 50 | 50 | No | +5 | −60 | +20 | −100[4] | No | Low |

TABLE 1-continued

Results Summary of Phase One Measured in Concrete Test Blocks

| TEST PARAMETERS Phase One Designation | | | | BEFORE RAIN (Imbedded Electrode | | CHANGES AFTER RAIN EVENT | | | |
|---|---|---|---|---|---|---|---|---|---|
| Block # | Mg, % | Zn, % | Active[2] | I, μa | V, mV[1] Ag/AgCl | I, μA[3] | V, mV[3] Ag/AgCl | Corroding | Protected[1] |
| 9 | 50 | 50 | Yes | 0 | −170 | +350[4] | −350[4] | No | High |
| 6 | 100 | 0 | No | 0 | −30 | +5 | −40 | No | Low |
| 5 | 100 | 0 | Yes | Bad electrical connection caused invalid data | | | | | |
| 10 | 25 | 75 | Yes | Bad electrical connection caused invalid data | | | | | |

Notes:
[1]Protected denotes a subjective evaluation of the current and voltage at the rebar, whether there is sufficient negative voltage and sufficient current to prevent rebar corrosion. The NACE standard for protection (with a coating in place) is that the potential of the rebar should be more negative than or equal to negative 750 mV, referenced to an Ag/AgCl half cell at 199 mV versus standard hydrogen (SHE) (manufactured by Broadley-James Corporation, Irvine, California, USA).
[2]Active denotes salt-ponded to induce corrosion
[3]Change in current and voltage occurs from time rain starts to about 0.7 days later.
[4]Sharp peak occurred after each rain FIG. 1 is a perspective view of a test block representative of the type used to develop the data in Table 1. The test block 100 includes a substrate 105, such as concrete, and embedded metal structures 110, such as reinforcing steel bars. The imbedded metal structures 110 included exposed sections 115, the sections 115 being coated to inhibit corrosion during testing. An external surface of the substrate 105 is coated with a liquid galvanic coating 120, in accordance with the invention, and allowed to dry. Depolarization was measured using an Ag/AgCl reference half-cell 125 and a mesh conductor 130 coupled to the galvanic coating 120 as shown.

Figure 2:
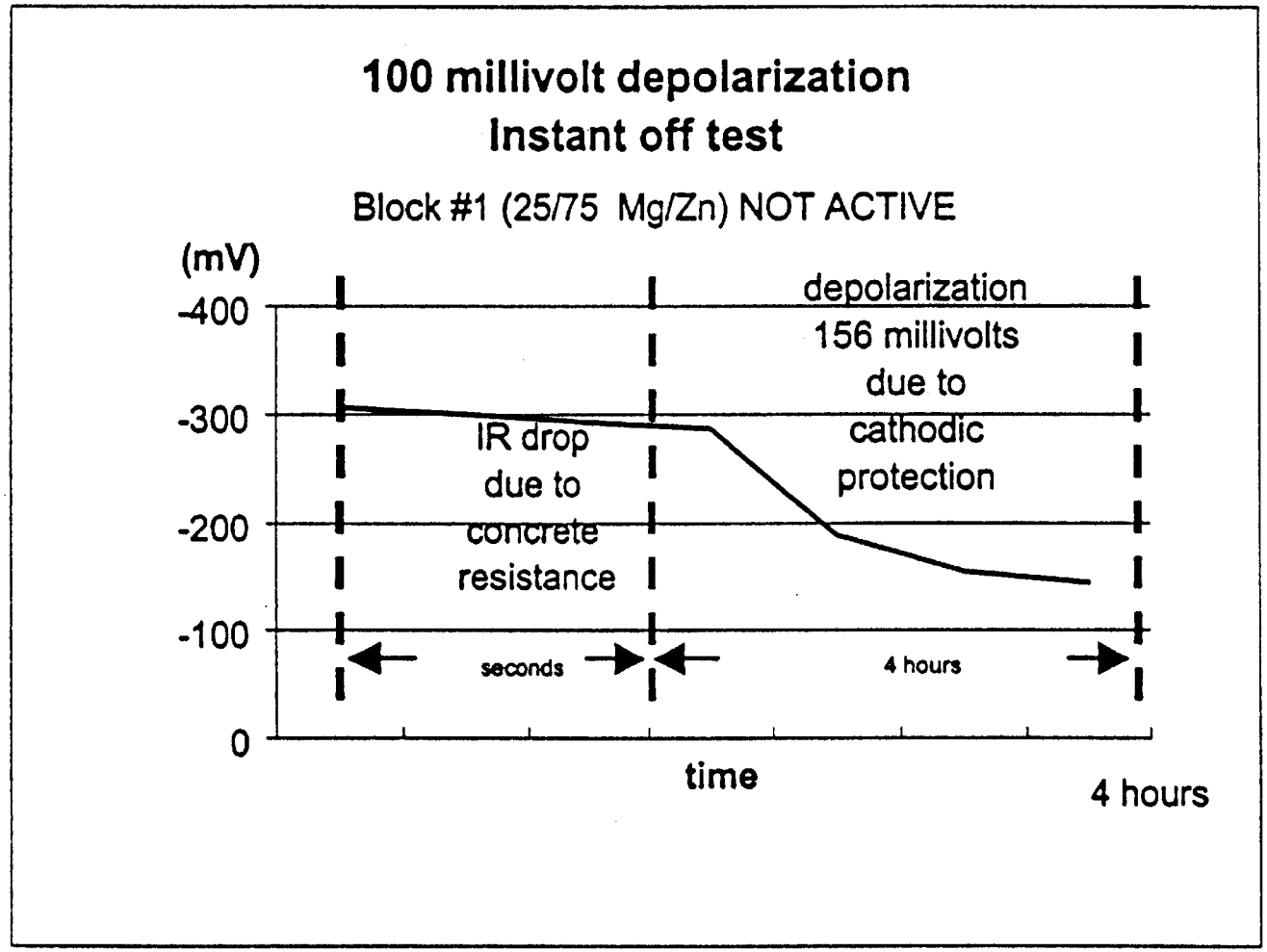
FIG. 2 is a graph of a depolarization test performed on a test block having a coating in accordance with an embodiment of the invention.
Figure 3:
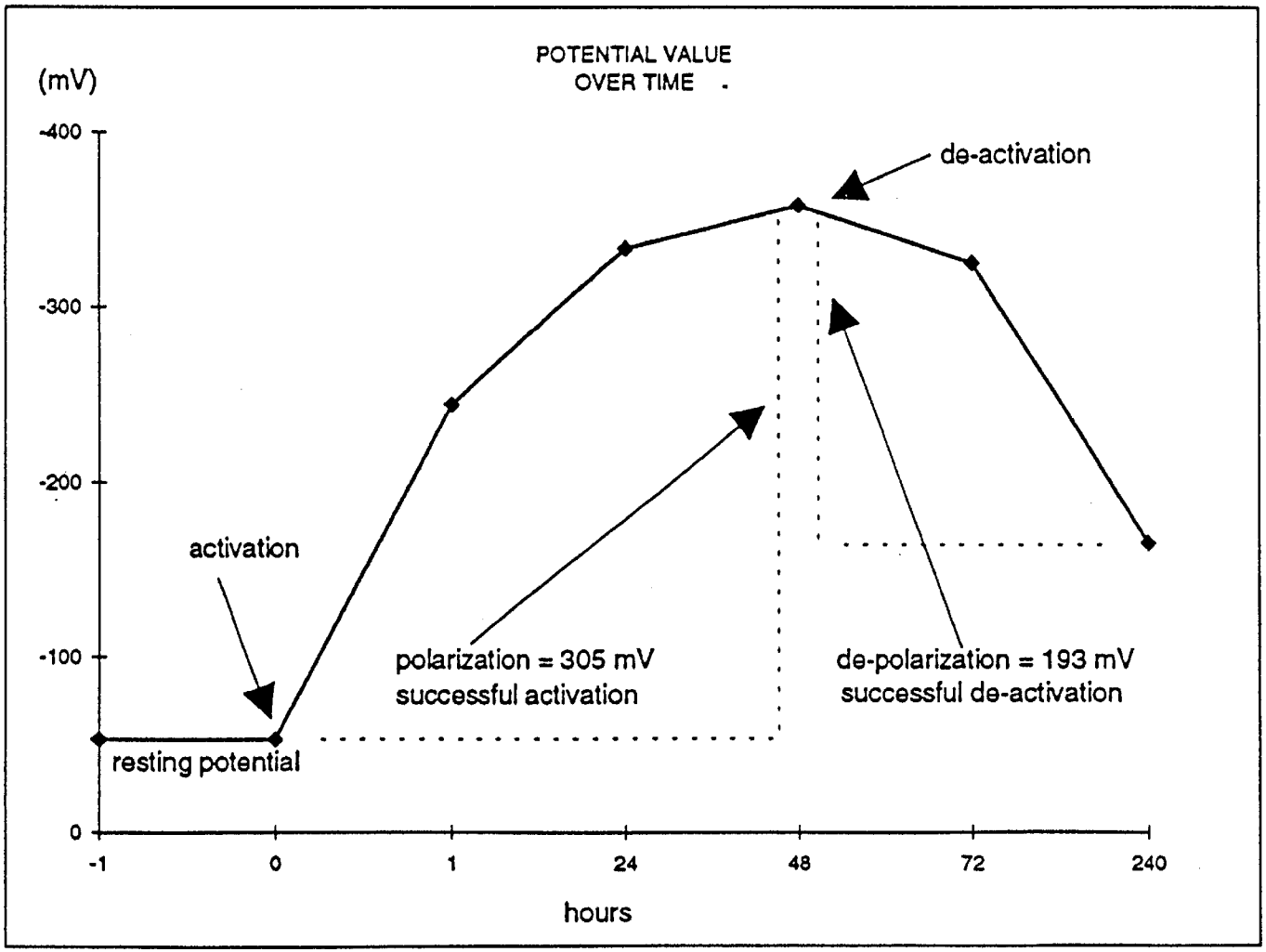
FIG. 3 is a graph of a polarization test performed on a test block having a coating in accordance with an embodiment of the invention.

The final selection of approximately 25% Mg and 75% Zn, by volume, was made on the basis of the depolarization method (instant-off). The results of these measurements, made in the field, are shown in Table 2. A graph of the depolarization test using a coating in accordance with an embodiment of the invention is shown in FIG. 2. FIG. 3 is a graph of a polarization test of a test block using a coating in accordance with an embodiment of the invention. Larger positive changes in the rebar potential after disconnection are generally indicative of improved performance.

TABLE 2

Results Summary of Phase One Depolarization Test

| Mg/Zn | Active | Block # | Depolarization, mV[1] |
|---|---|---|---|
| 25/75 | No | 1 | 156 |
| 0/100 | Yes | 4 | 78 |
| 100/0 | Yes | 5 | Bad Connection |
| 100/0 | No | 6 | 35 |
| 0/100 | No | 7 | 47 |
| 50/50 | Yes | 9 | 28 |
| 25/75 | Yes | 10 | 145 |
| 50/50 | No | 8 | Not Measured |

Notes:
[1]- Reference to an Ag/AgCl half cell at 199 mV versus standard hydrogen (SHE) (manufactured by Broadley-James Corporation, Irvine, California, USA)

The volume of metal was considered to be a desired criterion to hold approximately constant in the coating formula of the Phase One testing; the base volume was 151 mL of zinc (441 g of zinc powder) in 150 g of the commercial coating vehicle, enough to ensure that the coating would be electrically conductive. Table 3 depicts the amounts of the metal components used in various formulations for 150 g of commercial coating vehicle. The coatings were sprayed onto the test blocks, one coating on each block, and studied in Phase One.

TABLE 3

Phase One Metal Designations and Actual Weights Used in Coating Formulations with 150 g of Commercial Coating Vehicle

| Phase One Designation, % volume of total metal volume | Magnesium, g | Magnesium, mL | Zinc, g | Zinc, mL | Thinner, ml |
|---|---|---|---|---|---|
| Mg 100% | 102 | 210 | 0 | 0 | 15 |
| Mg 75% Zn 25% | 76 | 156 | 110 | 38 | 12 |
| Mg 50% Zn 50% | 50 | 103 | 220 | 75 | 10 |
| Mg 25% Zn 75% | 25 | 51 | 331 | 113 | 7 |
| Zn 100% | 0 | 0 | 441 | 151 | 5 |

Table 4 shows the seven example humectants selected for incorporation in the coating.

TABLE 4

Humectants Chosen for Phase Two Evaluation

| Our Abbreviation | Name | Humectant Type |
|---|---|---|
| CaS | Calcium Sulfate | Inorganic salt, hygroscopic |
| LiN | Lithium Nitrate | Inorganic salt, strongly hygroscopic |
| CuSPH | Copper Sulfate Pentahydrate | Inorganic salt, already fully hydrated |
| SG | Silica Gel, grade 62, 60–200 mesh, 150 Angstroms | Silica alumina solid powder, inorganic drying agent |
| PSS | Polystyrene Sulfonic Acid | poly(styrene sulfonic acid-co-maleic acid) sodium salt, 1-to-1 styrene, MAH mole (Aldrich), polymer drying agent |
| TEG | Tri-Ethylene Glycol | Organic liquid, hygroscopic |
| CuS | Copper Sulfate | Inorganic salt, unhydrated |
| NoPB | No paint, blank | Control 1 |
| NoHC | Coated, no humectant | Control 2 |

Table 5 shows the composition of a coating matrix in accordance with an embodiment of the invention.

TABLE 5

Phase Two Coating Matrix

| Phase Two Ingredient | Weight, g | Volume, ml |
|---|---|---|
| Commercial Coating Vehicle | 100 | 112 |
| Mg | 17 | 35 |
| Zn | 167 | 57 |
| Thinner | 18** | 18 |
| Humectant | 45 | 55 |
| TOTAL | 347 | 190 |

**Approximate amount: added to enhance flow

Upon mixing lithium nitrate as a humectant in the coating containing zinc and magnesium, the mixture got warm and appeared grainy. Thus, the coating mixture with lithium nitrate was brushed on the test block instead of sprayed. Lithium bromide was also tested, but it reacted with and solidified the mixture, becoming hot and unusable after a few hours in the mixing beaker.

Table 6 shows the concrete block test matrix with humectants and the record of polarization. Characterization of open circuit potential (OCP) was done by placing the given block in a 3-liter pool of 3.5% sodium chloride in DI (deionized) water.

TABLE 6

Concrete Block Identification Test Matrix

Open Circuit Potential, mV vs. Calomel Electrode

| ID # | Anode Disconnected | Anode Connected | Delta | Chemical |
|---|---|---|---|---|
| 14 | −528 | −716 | −88 | CaS |
| 15 | −385 | −496 | −181 | LiN |
| 16 | −516 | −568 | −52 | CuSPH |
| 17 | −539 | −649 | −110 | SG |
| 18 | −308 | −493 | −185 | PSS |
| 24 | −509 | −661 | −152 | TEG |
| 20 | −383 | −510 | −127 | CuS |
| 19 | −392 | N/A | N/A | NoPB |
| 2 | −355 | −817 | −462 | NoHC |

Various liquid coating compositions have been described containing magnesium and zinc. As applied, such coatings are capable of facilitating galvanic protection to imbedded metal structures through the resulting electrical connection between the coating as an anode and the imbedded metal structures as cathodes.

For one embodiment, the coating composition contains magnesium and zinc particles in a commercial coating vehicle, such as an inorganic silicate. The coating composition contains sufficient magnesium and zinc to remain conductive after drying or otherwise driving off the solvents of the coating vehicle. For a further embodiment, the volume of the magnesium in the coating composition is lower relative to the volume of the zinc in the coating position. For a still further embodiment, the coating contains a volume of metal in which approximately 40% or less of the volume of metal is magnesium. For a still further embodiment, the coating contains a volume of metal in which approximately 25% of the volume of metal is magnesium and approximately 75% of the volume of metal is zinc. The coatings may consist essentially of the zinc and magnesium in a coating vehicle. Such coatings may further contain additional chemical components that do not materially affect the basic and novel properties of the compositions disclosed herein, e.g., thinner added to obtain a desired application characteristic.

For another embodiment, the coating composition contains magnesium and zinc particles in a commercial coating vehicle along with a humectant. The humectant helps maintain the galvanic activity of the applied coating by attracting moisture to the coating. Example humectant materials include calcium sulfate, lithium nitrate, copper sulfate pentahydrate, silica gel, polystyrene sulfonic acid, triethylene glycol and copper sulfate. The coatings may consist essentially of the zinc, magnesium and any humectants in the coating vehicle. The humectant may contain one or more humectant materials.

The coatings of the various embodiments may be applied to the external surfaces of a substrate containing imbedded metal structures, such as reinforced concrete containing imbedded metal rebar. Electrical connectivity between the applied coating and the imbedded metal structures induces a electrical current providing cathodic protection to the imbedded metal structures with the coating acting as a sacrificial anode. Continued protection of the imbedded metal structures can be maintained by reapplying the coating, as necessary, to maintain electrical continuity.

For another embodiment, the coating composition contains magnesium and zinc particles in a commercial coating vehicle along with a catalytic metal. The catalytic metal helps maintain the galvanic activity of the applied coating by distributing the protection activity evenly throughout the sacrificial coating. In addition, the catalytic metal may delay or prevent passivation of the sacrificial coating. An example of a catalytic metal includes indium. The coatings may consist essentially of the zinc, magnesium and one or more catalytic metals in the coating vehicle. An amount of humectant may further be added as described herein.

For yet another embodiment, the coating composition contains magnesium and zinc particles in a commercial coating vehicle along with a super-conducting metal. The super-conducting metal helps maintain the galvanic activity of the applied coating by distributing the protection activity evenly throughout the sacrificial coating. In addition, super-conducting metals may delay or prevent passivation of the sacrificial coating. Examples of super-conducting metals include indium, cadmium and tin. The coatings may consist essentially of the zinc, magnesium and one or more super-conducting metals in the coating vehicle. An amount of humectant may further be added as described herein.

CONCLUSION

Coating compositions and methods of their use have been described for the reduction of corrosion in imbedded metal structures. The coatings are applied as liquids to an external surface of a substrate in which the metal structures are imbedded. The coatings are subsequently allowed to dry. The liquid applied coatings provide galvanic protection to the imbedded metal structures. Continued protection can be maintained with periodic reapplication of the coating compositions, as necessary, to maintain electrical continuity. Because the coatings may be applied using methods similar to standard paints, and because the coatings are applied to external surfaces of the substrates in which the metal structures are imbedded, the corresponding corrosion protection may be easily maintained.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any such adaptations or variations of the invention. It is manifestly intended that this invention be limited only by the following claims and equivalents thereof.

What is claimed is:

1. A method of preventing corrosion of metal in concrete, comprising:

surrounding a metallic member with concrete; and applying a liquid coating to the concrete surface, the liquid coating having metallic particles which provide a protective current to the metallic member.

2. The method of claim 1, wherein the metallic particles comprise magnesium and zinc particles.

3. The method of claim 2, wherein the metallic particles further comprise one or more catalytic metals.

4. The method of claim 3, wherein the liquid coating further comprises a humectant.

5. The method of claim 2, wherein the metallic particles further comprise one or more super-conducting metals.

6. The method of claim 5, wherein the super-conducting metals include at least one metal selected from the group consisting of indium, cadmium and tin.

7. The method of claim 5, wherein the liquid coating further comprises a humectant.

8. The method of claim 1, wherein the liquid coating further comprises a humectant.

9. A method of slowing corrosion of metal structures imbedded in a substrate, the method comprising:

applying a liquid coating to an external surface of the substrate;

wherein the liquid coating comprises zinc and magnesium in a coating vehicle; and wherein the liquid coating comprises a sufficient amount of the zinc and magnesium to remain conductive after application.

10. The method of claim 9, wherein the substrate is concrete and the imbedded metal structures comprise reinforcing steel in the concrete.

11. The method of claim 9, wherein the liquid coating consists essentially of zinc and magnesium in the coating vehicle.

12. The method of claim 11, wherein a ratio of a volume of zinc in the coating vehicle to a volume of magnesium in the coating vehicle is greater than approximately 1.6:1.

13. The method of claim 12, wherein a ratio of a volume of zinc in the coating vehicle to a volume of magnesium in the coating vehicle is approximately 3:1.

14. The method of claim 9, wherein the liquid coating further comprises an amount of humectant.

15. The method of claim 14, wherein the liquid coating consists essentially of zinc, magnesium and the humectant in the coating vehicle.

16. The method of claim 14, wherein the humectant comprises at least one material selected from the group consisting of calcium sulfate, lithium nitrate, copper sulfate pentahydrate, silica gel, polystyrene sulfonic acid, triethylene glycol and copper sulfate.

17. The method of claim 9, wherein the liquid coating further comprises one or more catalytic metals and wherein the liquid coating consists essentially of zinc, magnesium and the one or more catalytic metals in the coating vehicle.

18. The method of claim 9, wherein the liquid coating further comprises one or more catalytic metals and an amount of humectant and wherein the liquid coating consists essentially of zinc, magnesium, the one or more catalytic metals and the humectant in the coating vehicle.

19. The method of claim 9, wherein the liquid coating further comprises one or more super-conducting metals and wherein the liquid coating consists essentially of zinc, magnesium and the one or more super-conducting metals in the coating vehicle.

20. The method of claim 9, wherein the liquid coating further comprises one or more super-conducting metals and an amount of humectant and wherein the liquid coating consists essentially of zinc, magnesium, the one or more super-conducting metals and the humectant in the coating vehicle.

21. The method of claim 9, wherein the liquid coating comprises a volume of metal such that approximately 40% or less of the volume of metal is magnesium.

22. The method of claim 9, wherein the liquid coating comprises a volume of metal containing approximately 75% zinc and 25% magnesium by volume.

23. The method of claim 9, wherein the liquid coating further comprises:

a coating vehicle;

approximately 17 grams of magnesium per 100 grams of the coating vehicle;

approximately 167 grams of zinc per 100 grams of the coating vehicle;

approximately 45 grams of a humectant per 100 grams of the coating vehicle; and an amount of thinner sufficient to enhance flow of the liquid coating.

24. The method of claim 23, wherein the amount of thinner is approximately 18 grams per 100 grams of the coating vehicle.

25. A liquid coating, comprising:

a volume of zinc;

a volume of magnesium; and a volume of an inorganic silicate coating vehicle;

wherein the liquid coating comprises a sufficient volume of the zinc and magnesium to remain conductive after any solvents in the coating vehicle are driven off.

26. The liquid coating of claim 25, wherein the liquid coating consists essentially of zinc and magnesium in the coating vehicle.

27. A liquid coating, comprising:

a volume of zinc;

a volume of magnesium; and a volume of a coating vehicle;

wherein the liquid coating comprises a sufficient volume of the zinc and magnesium to remain conductive after any solvents in the coating vehicle are driven off; and wherein a ratio of the volume of zinc to the volume of magnesium is greater than approximately 1.6:1.

28. The liquid coating of claim 27, wherein a ratio of the volume of zinc to the volume of magnesium is approximately 3:1.

29. A liquid coating, comprising;

a volume of zinc;

a volume of magnesium; and a volume of a coating vehicle;

wherein the liquid coating comprises a sufficient volume of the zinc and magnesium to remain conductive after any solvents in the coating vehicle are driven off; and wherein the liquid coating further comprises an amount of humectant.

30. The liquid coating of claim 29, wherein the liquid coating consists essentially of zinc, magnesium and the humectant in the coating vehicle.

31. The liquid coating of claim 29, wherein the humectant comprises a material selected from the group consisting of calcium sulfate, lithium nitrate, copper sulfate pentahydrate, silica gel, polystyrene sulfonic acid, tri-ethylene glycol and copper sulfate.

32. The liquid coating of claim 29, further comprising:

wherein the volume of magnesium comprises approximately 17 grams of magnesium per 100 grams of the coating vehicle, the volume of zinc comprises approximately 167 grams of zinc per 100 grams of the coating vehicle, the amount of humectant comprises approximately 45 grams of the humectant per 100 grams of the coating vehicle; and wherein the liquid coating further comprises an amount of thinner sufficient to enhance flow of the liquid coating.

33. The liquid coating of claim 32, wherein the amount of thinner is approximately 18 grams per 100 grams of the coating vehicle.

34. A liquid coating, comprising:

a volume of zinc;

a volume of magnesium; and a volume of a coating vehicle;

wherein the liquid coating comprises a sufficient volume of the zinc and magnesium to remain conductive after any solvents in the coating vehicle are driven off; and wherein the liquid coating further comprises a volume of one or more catalytic metals.

35. A liquid coating, comprising:

a volume of zinc;

a volume of magnesium; and a volume of a coating vehicle;

wherein the liquid coating comprises a sufficient volume of the zinc and magnesium to remain conductive after any solvents in the coating vehicle are driven off; and wherein the liquid coating further comprises a volume of one or more super-conducting metals.

36. A liquid coating, comprising:

a volume of zinc;

a volume of magnesium; and a volume of a coating vehicle;

wherein the liquid coating comprises a sufficient volume of the zinc and magnesium to remain conductive after any solvents in the coating vehicle are driven off; and wherein the volume of magnesium is approximately 40% or less of a total volume of the volume of magnesium and the volume of zinc.

37. The liquid coating of claim 36, wherein the volume of zinc is approximately 3 times the volume of magnesium.

* * * * *